United States Patent [19]

Hamy

[11] 4,004,654

[45] Jan. 25, 1977

[54] ELEVATOR STRUCTURE SUPPORTING APPARATUS

[75] Inventor: Norbert Hamy, Beaconsfield, Canada

[73] Assignee: Trebron Holdings Limited, Beaconsfield, Canada

[22] Filed: Feb. 25, 1975

[21] Appl. No.: 552,807

Related U.S. Application Data

[63] Continuation-in-part of Ser. No. 269,453, July 6, 1972, Pat. No. 3,896,736.

[30] Foreign Application Priority Data

July 7, 1971 United Kingdom ..... 31821/71

[52] U.S. Cl. ..... 187/16; 105/149; 104/127

[51] Int. Cl.² ..... B66B 9/16

[58] Field of Search ..... 104/1 A, 76, 118, 89–93, 104/106–109, 124, 125, 88, 127, 148; 105/141, 147, 148–155, 261 A; 198/158; 187/16; 272/6, 7, 34, 39–43

[56] References Cited

UNITED STATES PATENTS

| | | | |
|---|---|---|---|
| 561,223 | 6/1896 | Hamilton | 104/127 |
| 2,488,523 | 11/1949 | Bilger | 104/1 A |
| 3,106,171 | 10/1963 | Julien | 105/149 |
| 3,366,224 | 1/1968 | Sauver | 198/158 |
| 3,487,789 | 1/1970 | Garner | 105/149 |
| 3,596,610 | 8/1971 | Keene | 105/261 A |
| 3,610,160 | 10/1971 | Albmanestianu | 104/76 |
| 3,698,326 | 10/1972 | Schurch | 104/118 |

*Primary Examiner*—Stanley H. Tollberg
*Attorney, Agent, or Firm*—Robert J. Schaap; Ian Fincham

[57] ABSTRACT

This invention provides a continuous flow elevator system wherein a plurality of cabs or cars are contained in a single shaft with means for switching the cabs from a set of continuous flow rails to a set of alternate rails associated therewith. There is also disclosed a supporting apparatus or bogie system permitting rotational movement of cabs in the above-mentioned elevator system.

11 Claims, 13 Drawing Figures

Au
Ad
S

ELEVATOR STRUCTURE SUPPORTING APPARATUS

This is a continuation-in-part of application Ser. No. 269,453 entitled Elevator Structure filed July 6, 1972 now U.S. Pat. No. 3,896,736.

This invention relates in general to certain new and useful improvements in service transport systems, and more particularly, to means for supporting a container member for movement on a pair of rails and for permitting relative shifting movement therealong and rotational movement with respect thereto.

Presently available elevator systems for use in multistorey buildings typically rely upon the movement of the ascending and descending movement of an elevator cab in a single shaft between vertically spaced access stations, usually the stories of a multi-storey building. A single elevator cab is located in each shaft and the cab moves between two end limits, and which are generally the uppermost level and the lowermost level in the structure.

These elevator cabs generally ride on a pair of opposed guide rails and are powered in their movement by large electric motors and support cables. The conventional elevator systems normally employ a counterweight which balances the weight of the elevator around a pulley arrangement. In large buildings with a high density population, the building is normally equipped with a series of elevator shafts with one elevator cab in each shaft, so that a series of elevators are used for the movement of people and freight. These elevator cabs are generally programmed during their movement by means of a complex electronic control system in order to obtain optimum handling capacity.

Generally, a building is designed with a number of individual elevator cabs, each being located in its own elevator shaft, to permit movement of a maximum number of people within a given time period at peak demand. Thus, a large building will usually require several elevator cabs which are designed to shift the occupants of the building between any of the several levels within a given time period, as for example the time required to shift a percentage of the occupants from the various levels to the ground level at a peak demand time. These elevator systems are inherently inefficient in that only one cab can occupy only one elevator shaft in both the up and down movements thereof. Furthermore, they are highly inefficient in that the normal waiting time and the delay in shifting building occupants from one level to another level is usually quite long creating a substantial inconvenience factor. The present standards of elevator system performance is based on the capacity to handle about 12 to about 15% of the total building population in a five minute interval. One typical multi-storey building having 110 storeys for housing 16,000 occupants proposed the use of 88 individual elevator shafts or a total of 88 separate double decks. The system is designed so that it can handle approximately 2400 people in 5 minute intervals, and this efficiency generally represents the state of the art in high density elevator designs.

An invention which obviates these and other problems in the provision of a continuous flow transport system which utilizes a set of continuous flow rails and a set of alternate rails associated therewith with cap switcher means operating therebetween permitting a plurality of independently drivable cabs to be employed in one shaft or on a plurality of tracks is described in co-pending U.S. application Ser. No. 269,453. As described, a moving cab may be directed from the continuous flow rails to the alternate rails for temporary stopping at an access station and also permitting other cabs to pass. This system is highly efficient in that it provides an inherent reduction in space requirements for a given flow capacity thereby increasing not utilizable area as a result of the optimized flow area utilization. Furthermore, when used in service lift systems, the high efficiency of this system will significantly reduce total building costs by as much as 10 to 12% in many cases. From the standpoint of the building occupants, the system is highly effective in reducing waiting time and otherwise eliminating the inconvenience normally associated with elevator travel.

Briefly, the transport system, as described in the above referred to co-pending application comprises continuous flow guide rail means, alternate rail means spaced from and co-operating with the guide rail means and being located proximate to the access stations. A plurality of service capsules are independently drivable on said guide rail means in a flow direction. Furthermore, the system includes selectively operable means for diverting a capsule between the flow guide rail means and the alternate guide rail means, whereby capsules on said flow guide rail means may pass capsules on said alternate rail means.

In more detail, the alternate rail means have portions parallel to the guide rail means. The guide rail means comprise a pair of spaced apart guide rails in the form of continuous loops and the alternate rail means comprise a pair of spaced apart alternate rails, each of the alternate rails being located in proximity to an associated one of said pair of guide rails. Preferably, the alternate rails are substantially parallel to the guide rails for the greater portion of their length.

In a preferred aspect of the above system, an individual prime mover means, preferably in the form of one or more linear induction motors is operatively associated with each individual capsule for powering the movement of the same along the aforesaid rail means. Also, in this aspect, the selectively operable means, is a capsule diverting mechanism which includes cross-over rails from the guide rail means to the alternate rail means. This capsule diverting mechanism is interposed in sections of the guide rail means and the alternate rail means and is pivoted in one direction to shift capsules from the guide rail means to the alternate rail means and in the opposite direction to shift capsules from the alternate rail means to the guide rail means.

The transport system above described can be used in a variety of modes and in one mode, the transport service system is a service lift or elevator system where substantial portions of the guide rail means and the alternate rail means are vertically disposed and several of the access stations are vertically arranged with respect to each other. In another mode, the service transport system is a system for movement of capsules to a plurality of access stations which are generally horizontally disposed with respect to each other. In another aspect, the service transport means includes the guide rail means and alternate rail means having portions located in generally horizontal planes and portions located in generally vertical planes and in this case, the access stations are both horizontally and vertically located with respect to each other.

In one aspect, this elevator system can be characterized in that a plurality of capsules are movable on the rail means in a continuous flow path with intermittent stops at certain of the access stations. In this elevator system, first auxiliary rail means are associated with the first rail means and second rail means. In this case, means permit selective shifting of the capsules from the first rail means to the first auxiliary rail means and back and also selective shifting of the capsules from the second rail means to the second auxiliary rail means and back. In like manner, the capsules in this elevator system are each provided with individual prime movers for powering the movement of the capsules on all of the rail means.

The present invention provides an apparatus for supporting the container members such as the capsules for movement on a pair of rails and which permits relative shifting movement therealong and rotational movement with respect thereto. This apparatus can be described in general terms as comprising a first frame means, and wheel means carried by the first frame means and rotatably disposed on the rails permitting movement of the first frame means therealong. The apparatus also includes a second frame means pivotally mounted on the first frame means and also being movable therewith. Link means extends between and pivotally connects the container member and the second frame means thereby permitting movement of the container with the first frame means and rotatable movement with respect thereto.

In one aspect of the present invention, this apparatus can be further characterized in that a prime mover is operatively mounted with respect to the first frame means for powering movement of the container on the pair of rails. This apparatus also includes fluid actuable means which actuate the aforesaid link means to shift the container relative to the first frame means and the second frame means. In addition, clutch means is operatively associated with the second frame means permitting substantially the same angular relationship of the container to the rails during shifting movement with respect to the second frame means.

In this aspect of the present invention, the second frame means are generally the stationary bogie frames and the first frame means are the rotational bogie frames. The containers would constitute the various capsules used in the transport of people and/or freight. The said first rail means would generally constitute the continuous flow guide rails and the second rail means would generally constitute the auxiliary rails. The link means are preferably in the form of a plurality of capsule supporting arms which extend from the second frame means to the capsule and are pivotally connected to each. In this embodiment of the invention, the fluid actuable means would preferably take the form of a hydraulic ram.

Having thus described the invention in general terms, reference will now be made to the accompanying drawings which form a part hereof and in which:

Figures 11, 11A:
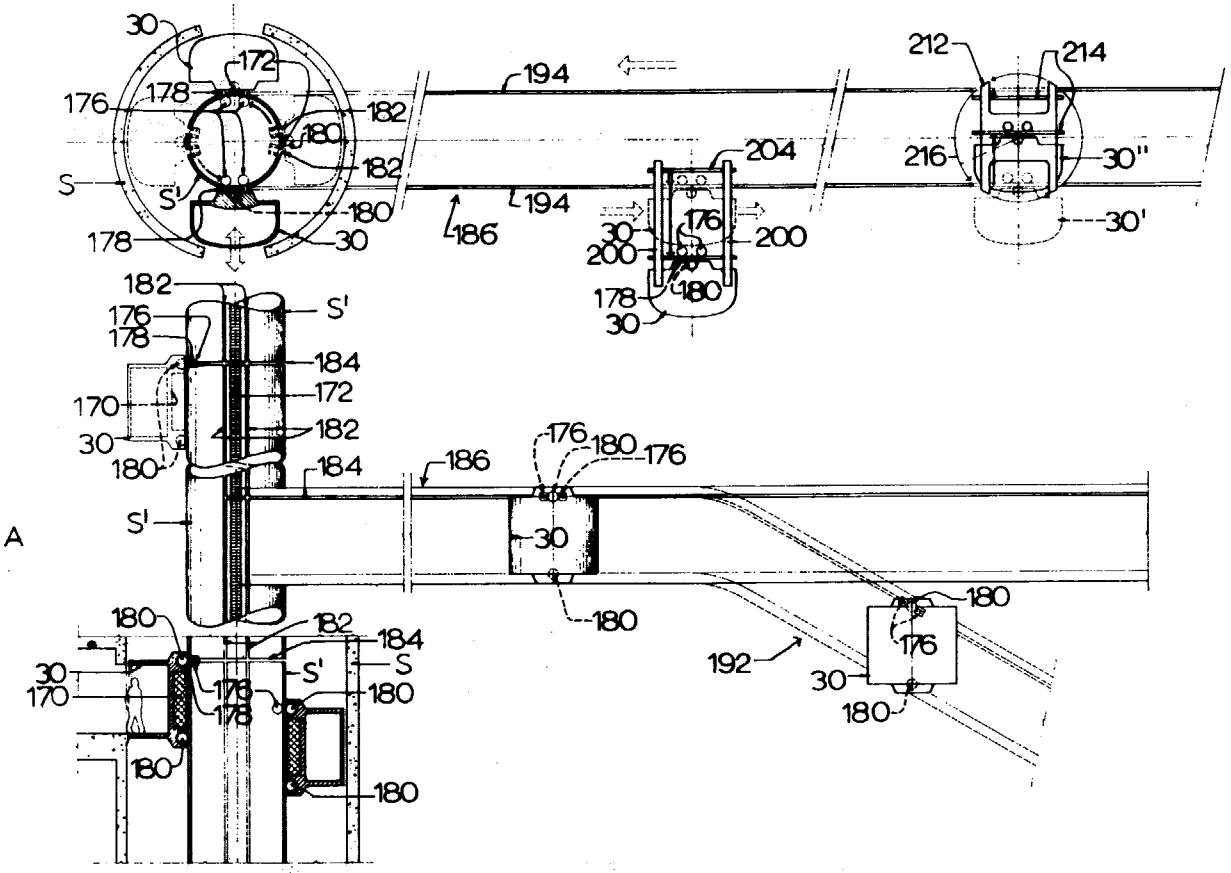
FIG. 11 is a top sectional view of an alternate system.
Figure 12:
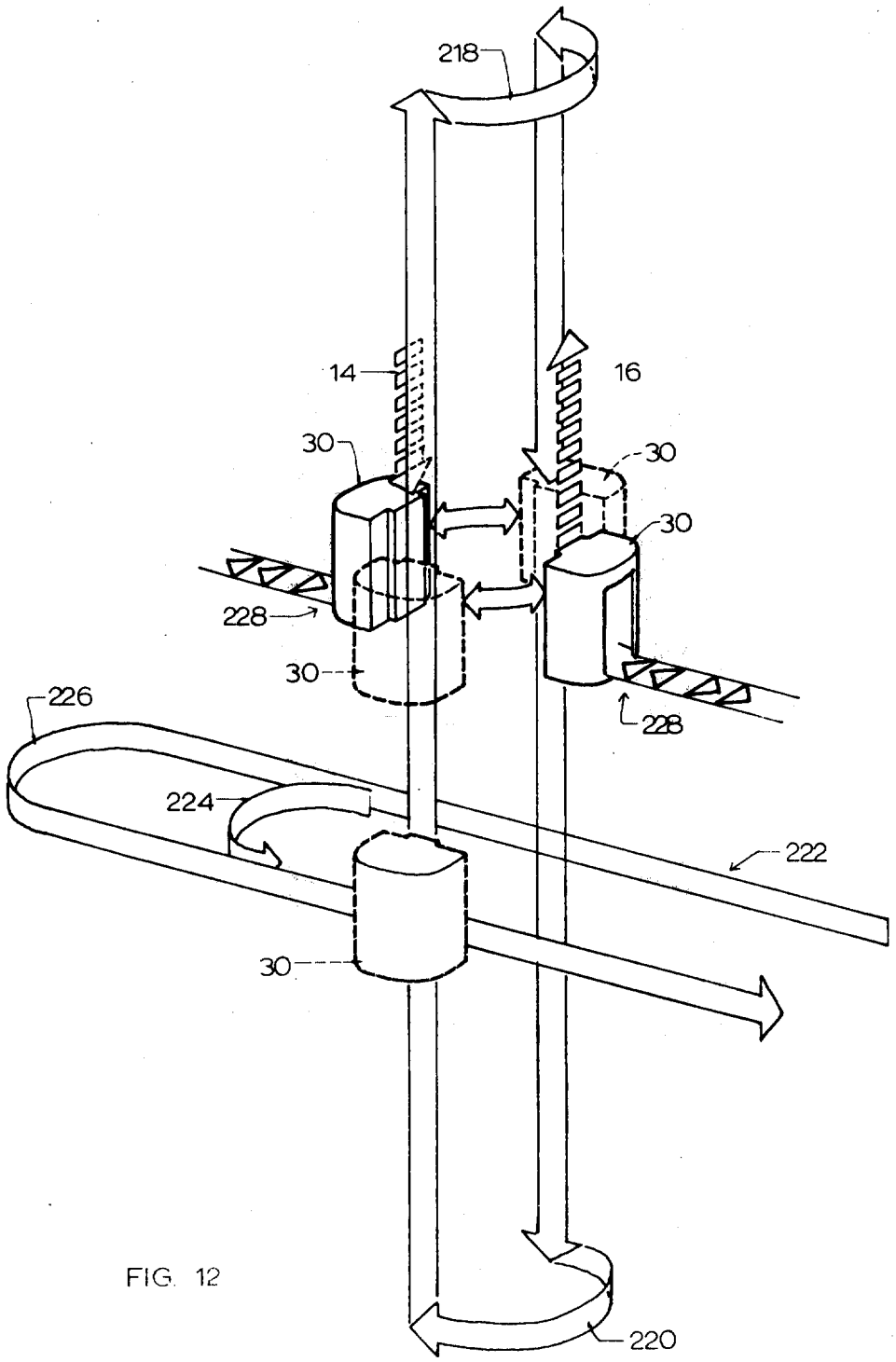

FIG. 11*a* is a side elevational view, partially in section of the system of FIG. 11; and FIG. 12 is a perspective amplified view of an alternate embodiment.

Referring now in more detail and by reference characters to the drawings which illustrate practical embodiments of the present invention, T designates one form of service transport system which may be used with facilities having a plurality of access stations. In the embodiment of the invention illustrated in FIGS. 1 – 7, the service transport system T takes the form of a service lift system such as a continuous flow elevator system. However, it should be recognized that essentially the same construction could be used in other forms of service transport systems.

Figure 1:
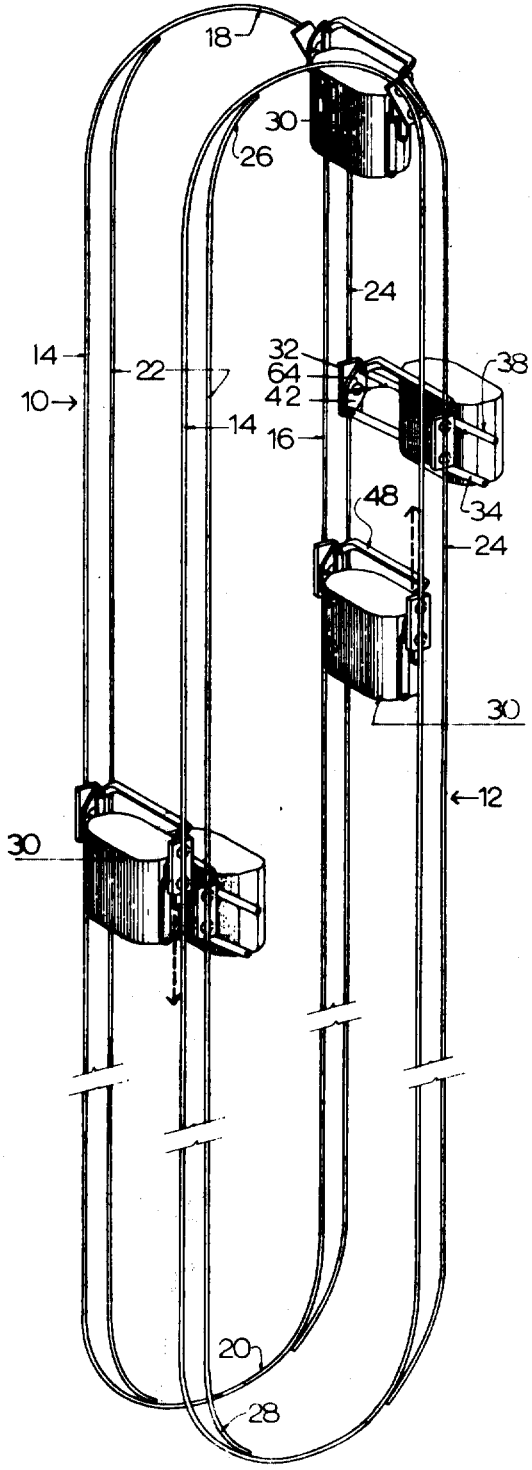
FIG. 1 is a perspective view, in schematic form of the looped rail configuration.
Figure 3:
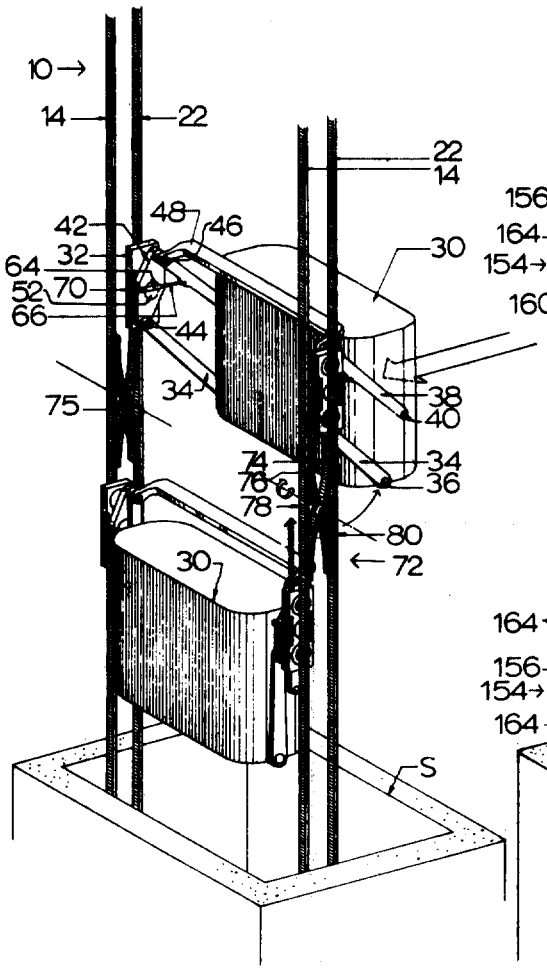
FIG. 3 is a perspective view, partially broken away, showing a portion of the cab and rail mounting assembly.
Figures 4, 5, 6, 7:
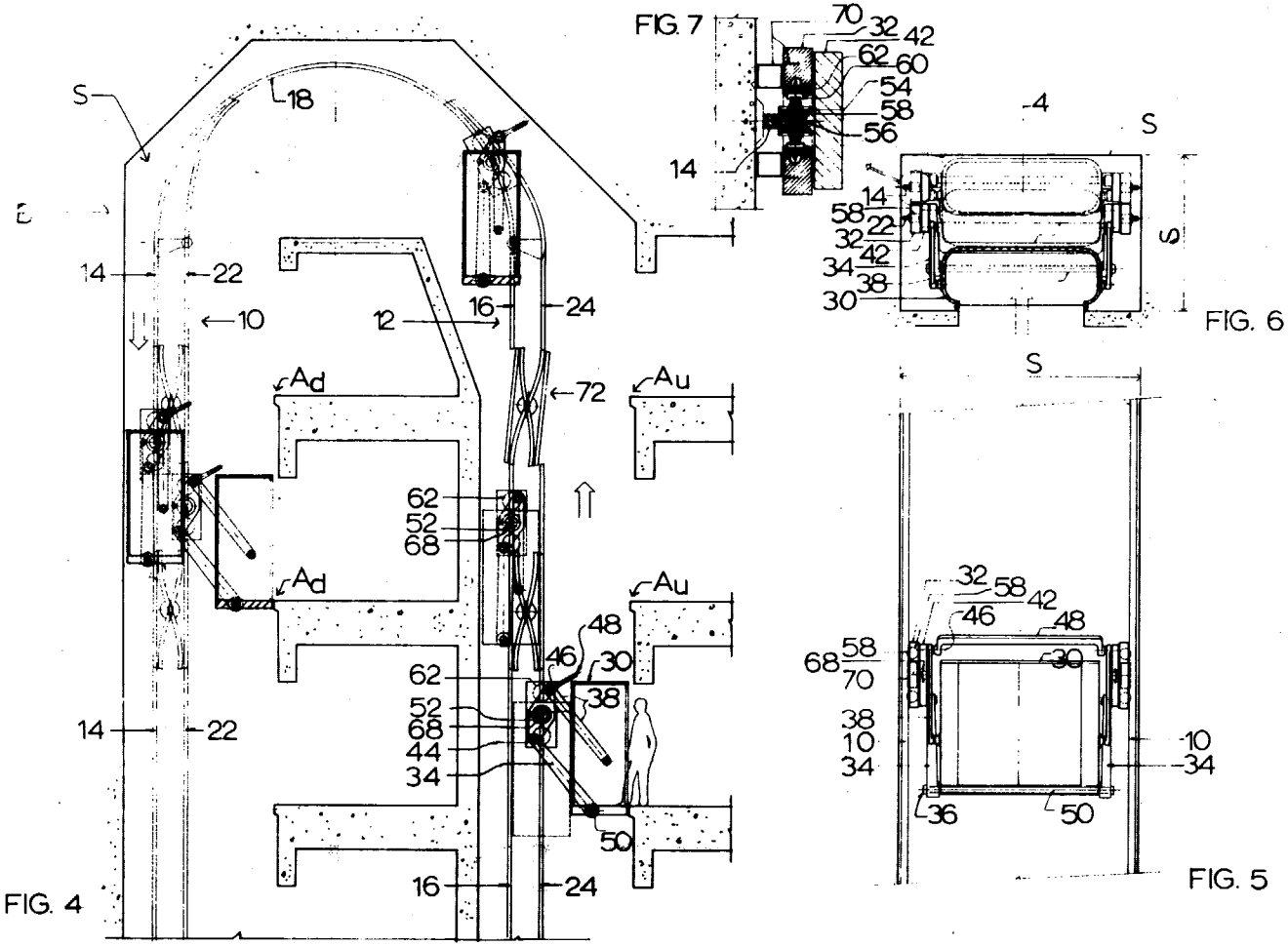
FIG. 4 is a vertical section view showing details of a service transport system.
FIG. 5 is a front elevational view of a portion of the service transport system of FIG. 4.
FIG. 6 is a top plan view of the service transport system of FIG. 4.
FIG. 7 is a vertical sectional view taken along line 7—7 of FIG. 6.

Referring now to FIGS. 3 and 4, S designates an elevator shaft formed in a building B which is provided with a plurality of access stations $A_u$ on the ascending leg of the flow path and a plurality of access stations $A_d$ on the descending leg of the continuous flow path. In this connection, it is possible to provide a pair of cooperating shafts in the building, one of which carries rails for ascending movement and the other of which carries rails for descending movement. However, with reference to the arrangement of FIGS. 3 and 4, a pair of spaced apart continuous flow guide rails 10 and 12 are suitably mounted within the elevator shaft S and each are constructed in looped configuration. Furthermore, each of the guide rails 10 and 12 include a pair of spaced apart vertical rail portions 14 and 16 connected at their upper and lower ends by arcuate connecting portions 18 and 20, in the manner as illustrated in FIG. 1. The vertical rail portions 16 serve as descending legs and the vertical rail portions 14 serve as ascending legs.

Alternate rails or so-called "stopping rails" are associated with each of the vertical rail portions 14 and 16 of each of the continuous guide rails 10 and 12. Thus, it can be observed that a descending alternate rail 22 is associated with the vertical rail portion 14 and an ascending alternate rail 24 is associated with the vertical rail portion 16 of the continuous flow guide rail 10. In like manner, a descending alternate or stopping rail 22 is associated with the vertical rail portion 14 and an ascending alternate or stopping rail 24 is associated with the vertical rail portion 16 of the continuous guide rail 12. It can be observed that the alternate rails 22 are provided with arcuate portions 26 and 28 at their upper and lower ends respectively, and which become adjacent to and essentially merge into the upper arcuate portions 18 and lower arcuate portions 20 of the respective guide rails 14 and 16.

A plurality of service capsules or cabs 30 are provided for movement on the continuous flow guide rails 14 and 16 and on the alternate rails 22 and 24. By reference to FIG. 1, it can be observed that the cabs 30 are movable in an upwardly direction on the right-hand portion of the continuous flow tracks 10 and 12 and therefore, the legs 16 of these rails constitute "ascending rails" as aforesaid, and the cabs 30 will move in a downwardly direction on the track portions 14 which constitute "descending rails" also as stated above. It can be observed that the cabs 30 are therefore adapted for continuous flow movement along the continuous flow rails 10 and 12 and in such manner that they will ascend on the ascending rails 16 and switch over to the descending rails 14 through the arcuate portions 18 at the upper end thereof. In like manner, they will switch from the descending rails 14 to the ascending rails 16 at the arcuate sections 20 on the lower ends thereof. Furthermore, they may ascend and descend on the alternate tracks 24 and 22, respectively, in a manner to be hereinafter described in more detail.

Each of the cabs 30 are operatively suspended between stationary co-operating bogie frames 42 and two rotatable or rotational spaced apart and co-operating bogie frames or so-called "capsule carriers" 32, each being operatively associated with one of the continuous flow guide rails indicated generally by numerals 10 and 12. The rotatable frames 32 are not stationary in their relative position to the rails since they do move on the rails and they rotate on the rails on which they ride relative to the cab. The stationary frames 42 are referred to as being stationary with reference to the cabs 30 since they move only with the cabs 30 and rotate relative to the rails upon which they ride. The cab 30 is pivotally secured to a pair of lower suspension arms 34 by means of pivot pins 36 and a pair of upper suspension arms 38 by means of pivot pins 40 in the manner as illustrated in FIGS. 1, 3 and 4. Each of the arms 34 and 38 are, in turn, pivotally secured to stationary bogie frames 42 by means of respective pivot pins 44 and 46. This assembly is reinforced by means of an upper cross-bar 48 which is also retained by the upper pivot pins 46 and a lower stabilizing bar 50 which is retained by the pivot pins 36 on the cab 30.

The stationary bogie frames 42 are then, in turn, pivotally secured to each of the opposite and associated rotatable bogie frames 32 by means of central axis pivot pins 52. Each of these rotational bogie frames 32 carries a pair of double-cone steel wheels 54 which guide the entire cab assembly along the rails 14 and 16 as well as the auxiliary rails 22 and 24. Each of the rails used in the system of the present invention are preferably rectangular in horizontal cross-section and conical sections 56 of these wheels are sized to accommodate the various rails in the manner as illustrated in FIG. 7. The wheels 54 are integrally provided with axially extending hubs 58 which are journalled in roller bearings 60, the latter being retentively held within the rotational bogie frames 32. Furthermore, each of the two wheels 54 in each of the boggies can rotate 360° through a swivel ring carrier 62 which also serves to hold the bearings 60, in the manner as illustrated in FIG. 7.

A hydraulic ram 64 is mounted on each of the boggie frames 42 and each have extendable pistons 66 which are pivotally connected to the upper suspension arms 38 in the manner as illustrated in FIG. 3. Thus, upon actuation of the hydraulic ram 64 the pistons 66 will extend, thereby forcing the upper suspension arms 38 to pivot about the pivot pins 36 and in this way urge the cab 30 outwardly from the respective continuous rails 14 and 16. In like manner, upon actuation of the hydraulic ram 64 in the opposite direction, the pistons 66 will retract thereby permitting a lowering of the cab 30 through the action of the suspension arms 38 and which also will permit a shifting of the cab 30 toward the continuous rails 14 and 16. This action is more fully illustrated in FIGS. 1 and 3 of the drawings and it can be observed that when the pistons 66 are completely retracted, the cabs 30 will essentially lie between the continuous rails 14 and 16 and when the piston 66 is extended through the actuation of the ram 64, the cabs 30 will be shifted outwardly so that they lie adjacent to or in close proximity to any of the upper access stations $A_u$ or any of the lower access stations $A_d$ in the manner as illustrated in FIG. 4.

A concentric position control plate clutch 68 permits alignment of the cab 30 through its central axis pivot pins 52, (or any conventional compensating gear drive may be used), and which relates vertically to the constantly variable angularity of the rotational boggie 32 during a transport cycle. It can also be observed that the various suspension arms 34 and 38 will form a parallelogram in order to allow a lateral transposition from the moving position (the lower cab 30 illustrated in FIG. 3) to the access or stopped position (the upper cab 30 illustrated in FIG. 3) while the cab maintains its verticality through the concentric position control plate clutch 68.

Each of the rotational bogie frames 32 are provided with one or more electrical motors, and preferably linear induction motors 70, for driving the cab assemblies on the continuous rails 14 and 16 as well as the alternate rails 22 and 24. Those linear induction motors 70 are designed to provide both the motive power and the braking power used for movement of the various cabs 30. Thus, it can be observed that each of the cabs 30 are individually powered for movement along any of the previously described rails. It has been found that linear induction motors with a power rating of 200 horsepower can provide 3500 pounds to approximately 4000 pounds of thrust and in this system, can provide cab flow acceleration of 3.5 feet every two seconds. It should also be noted that a guidance control system (not shown) would be provided for controlling the movement of the various cabs 30 along the aforementioned rail and this guidance control system would be provided with collision avoidance circuitry so that the entire system would operate in a fail-safe condition.

A rail diverting mechanism 72 is provided at each access station along the ascending rails 16 and 24 and along each of the access stations $A_d$ on the descending rails 14 and 22. Each of the rail diverting mechanisms 72 comprises switching rails 74 and 76 which cross and are pivotally mounted on a single pivot switching mechanism 75. The switching rails 74 and 76 are each secured at their outer surfaces to extension rails 78 and 80. The extension rails 78 form continuations of the relatively vertical rail portions 14 and 16 of the continuous guide rails 10 and 12, and the extension rails 80 form continuations of the alternate rails 22 and 24. In this way, when the rail diverting mechanism is located in the non-diverting position that is the position as illustrated in FIG. 3, a cab 30 will continue movement on the continuous flow rails 10 and 12. However, it can be observed that when the rail diverting mechanism 72 is pivoted slightly about the pivot mechanism 80, the rotational bogie frame 32 will shift from the continuous flow rails 14 to the alternate rails 22 or in the reverse from the alternate rails 22 to the continuous flow rails 14 (or conversely from rails 16 to 24).

By reference to FIG. 4, it can be observed that when the rail diverting mechanism 72 has been pivoted about the pivot mechanism 80 in the clockwise direction, a cab 30 will be diverted from the continuous flow rails 14 to the alternate rails 22. In like manner, it can also be understood that if the cab diverting mechanism 72 were pivoted in the counterclockwise direction about the pivot mechanism 80 the lower portion of the switching rail 76 would become contiguous with the alternate rail 24 and the upper portion of the switching rail 76 would become contiguous with the vertical rail portion 16 of the continuous flow rails 10 and 12. In this case, the cab 30 will be shifted back from appropriate alternate rail to the continuous flow rails.

Figure 2:
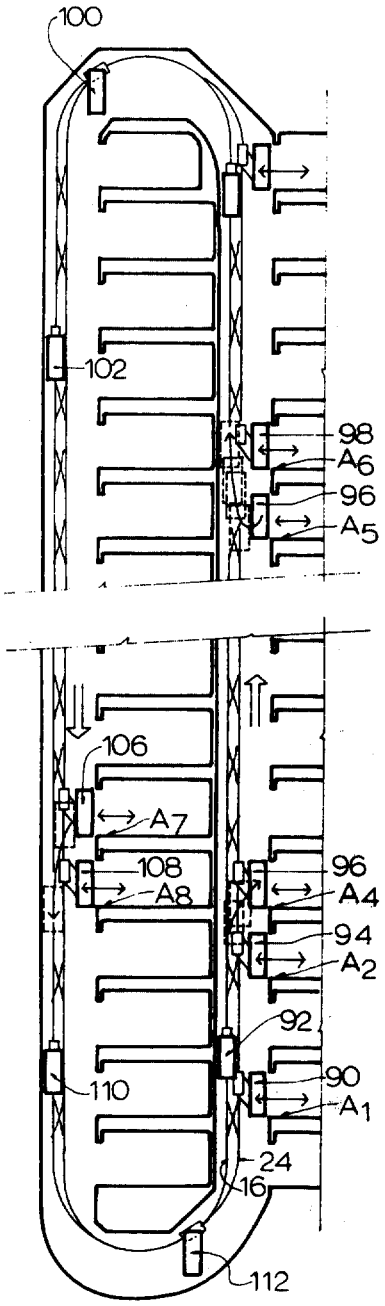
FIG. 2 is a schematic side elevational view showing the loop operation of service capsules and the continuous flow pattern utilized in a service transport system.

The operation of the transport lift system can best be observed by reference to FIGS. 2 and 4. A series of cabs 30 would be provided for movement along the continuous flow rails 10 and 12. When it is desired to stop a cab 30 at any particular upper access station $A_u$ the cab is switched from the continuous flow rails 10 or 12 to the alternate rails, and during the time of switching, the cab decelerates until it reaches a fully stopped position as illustrated in FIG. 4. In this case, the cab is swung outwardly from the rails so that it is located in abutting relationship or otherwise in very close proximity to any of the upper access stations $A_u$. The lowermost cab illustrated in FIG. 4 shows the cab 30 in the access position ready to receive a passenger or other cargo form. After the desired content, including passengers and freight or cargo, have been introduced into the cab 30, it is shifted by means of the suspension arm 34 and 38 to its low position and simultaneously will be shifted by the cab diverting mechanism 72 from the alternate track 24 to the continuous flow rails 16.

The continuous flow of the various cabs in the transport system of the present invention is illustrated schematically in more detail in FIG. 2. It can be observed that a cab 90 which is substantially identical to the cab 30 is located in a stationary condition in the access position at the first upper access station $A_1$. It can also be observed that this cab 90 is located on the auxiliary tracks 24. A cab 92 is passing the cab 90 on the continuous flow rails 10 and 12. Furthermore, cabs 94 and 96 are located at the access stations $A_2$ and $A_4$ respectively, and these cabs are also temporarily stationed on the auxiliary rails 24. Cab $96^1$ as station $A_5$ is beginning its movement from the access position and starting to bypass a stationary cab 98 located at the next access station $A_6$. Furthermore, it can be observed that a cab 100 is passing over the arcuate section 18 in order to start the descent from the uppermost access station to the lowermost access station. Thus, a cab 102 is moving downwardly on the continuous flow rails 14. However, a cab 106 is in the access position at a down access station $A_7$ and in dotted form, this cab is starting its movement downwardly and bypassing the stationary cab 108 located at the access station $A_8$ to re-enter the continuous flow path. A cab 110 is also moving on the continuous flow rails 14 toward the bottom arduate section 20, and it can be observed that a cab 112 which is in the process of traversing the bottom loop will again begin the ascent path.

Thus, it can be observed that the various cabs 30 operate on a continuous flow basis while in transit and in this case will move along the continuous flow rails 14 and 16 and will begin to decelerate to a stopped position and accelerate from a stopped position at the access stations on the alternate rails 22 and 24 and the associated cab diverting mechanisms 72. Furthermore, cabs in transit will always bypass those cabs which are located at access stations, or which are decelerating to stop at an access station, or which are accelerating away from an access station. This operation will allow a minimum of waiting time for any cab while optimizing the utilization of the shaft S. In this connection, only one shaft is needed for the upper or ascending movement and the descending movement. However, in the interest of conservation of floor space, in many cases it may be desirable to employ one shaft for ascending movement and another shaft for descending movement where the rail sections 16 will be located in the ascending shaft and the rail sections 14 will be located in the descending shaft. In this case, the alternate tracks 22 will be located in the descending shaft and the alternate tracks 24 will be located in the ascending shaft. Furthermore, the two shafts would then be connected by the arcuate sections 18 and 20. The number of cabs which are used will be determined by the number of access stations and the overall dimension of the facility in which the continuous transport system is used. Thus, in an elevator system, the number of cabs will increase as the height of the building increases.

It can be observed that the cab will always maintain proper vertical alignment since it is suspended between the two rotational bogies 32 by means of the stationary bogies 42. The bogies 32 will continually reverse their positions as they pass around the arcuate sections 18 and 20. Nevertheless, the cab will always again maintain its true vertical position.

Figures 8, 9:
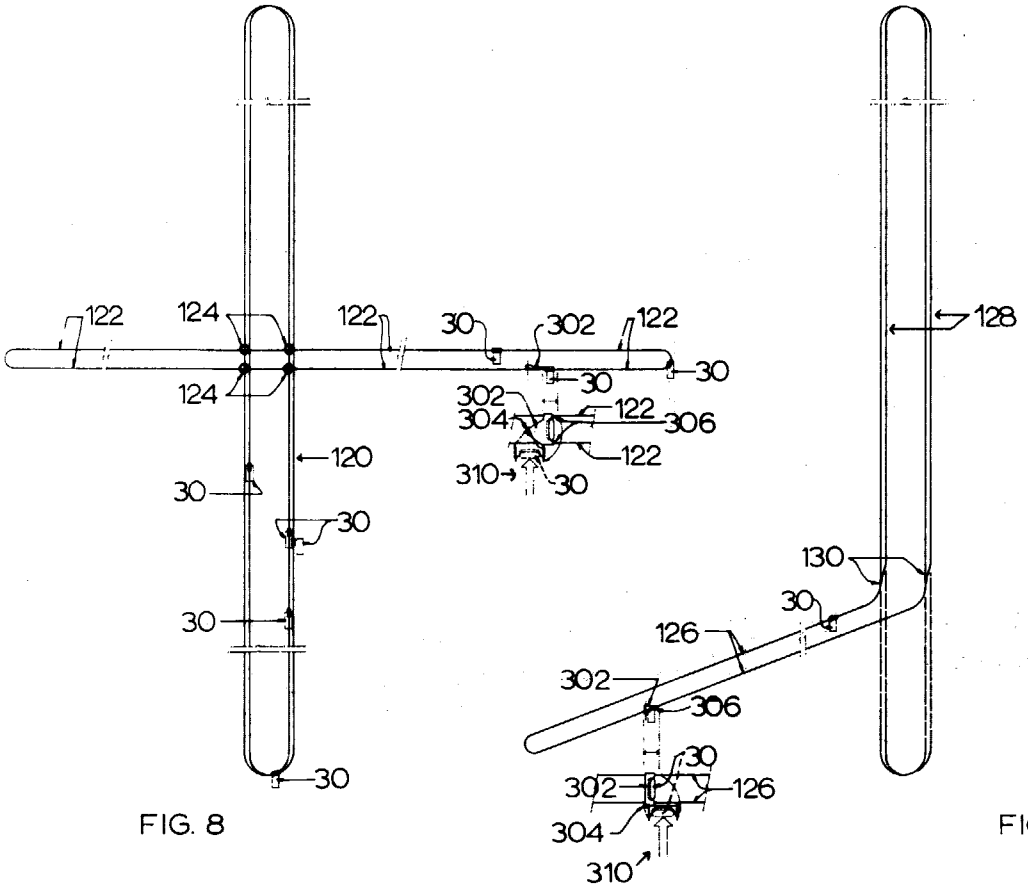
FIG. 8 is a schematic top plan view of a modified form of continuous flow loop arrangement with cooperating vertical and horizontal paths.
FIG. 9 is a schematic top plan view of a further modified form of continuous flow loop arrangement.

It should be understood that the transport system can be operated in both vertical, horizontal and sloped arrangements and in a vertical and horizontal combination in the manner as illustrated in FIG. 8. Thus, a pair of continued looped tracks 120 and 122 would be provided with switching tracks 124 permitting interchangeable operation from horizontal loop rails 122 to the vertical loop rails 120. Furthermore, it should be obvious that one or more sets of horizontal rails could interconnect any number of vertical sets of rails in one building, or in multi-building complexes.

FIG. 9 discloses another arrangement where an inclined access loop 126 connects to a vertical loop 128 by means of a rail switching arrangement 130. This type of arrangement is applicable in many special terrain situations or in special urban requirements. It should also be noted that any combination of these various arrangements could be employed. Thus, in a horizontal loop arrangement as opposed to a vertical loop arrangement, the various cabs could operate for transporting passengers or freight from one location to another such as in the operation of a subway system. The transport system is uniquely adapted to operate as a ground surface or underground transport system, in that it is also highly efficient in vertical and horizontal modes of operation.

With respect to above-described FIGS. 8 and 9, there is illustrated also a modified switching arrangement. In FIG. 8, this arrangement is adapted to provide for movement of the elevator cabs from the continuous circuit to access stations for interconnection to other circuits. In FIG. 8, the switching arrangement includes a pivotally mounted switch-out frame indicated by reference numeral 302 which is fixedly secured to the elevator shaft or the like and pivots about a pivot point 304. Frame 302 is of a generally U-shaped configuration and is adapted to receive the rotational bogies indicated generally by reference numeral 306 (such as of the type described above relative to reference numeral 32 or of the type described hereinafter with respect to FIGS. 11 and 12) associated with the elevator cab 30 on each side member of the U-shaped switch-out frame 302. In this embodiment, the switch-out zone (shown in FIG. 9 in a partial plan view) is operable when it is desired to switch a cab from the continuous horizontal rails 122 to an access station indicated generally by reference numeral 310. To this end, and operating in conjunction with the switch-out frame 302 are a pair of secondary rail segments (not shown) operating in conjunction with the horizontal rails 122 such that when a cab 30 is adapted to be displaced from the horizontal rails 122, a pair of opposed segments of the rails 122 are permitted to rotate with the cab from the balance of the continuous rails 122 so that the secondary rails assume the configuration of the displaced portions of the rails 122. This may be accomplished by the arrangement described hereinafter with respect to FIGS. 11 and 12. In this manner, by pivoting the switch-out frame 302 with the cab and segments of the rails 122, the cab 30 may be moved to the position shown in dotted lines in FIG. 8 at an access station to permit loading and/or unloading. FIG. 9 also illustrates a similar arrangement, but the switch-out frame 302 is pivoted at a slightly different point 304', and by using secondary rail segments as described above, the cab 30 may be pivoted by the switch-out frame 302 with segments of the rails 126 to an access station (the secondary rail segments taking the place of the displaced rail segments 122 to permit continuous movement by other cabs).

Figure 10:
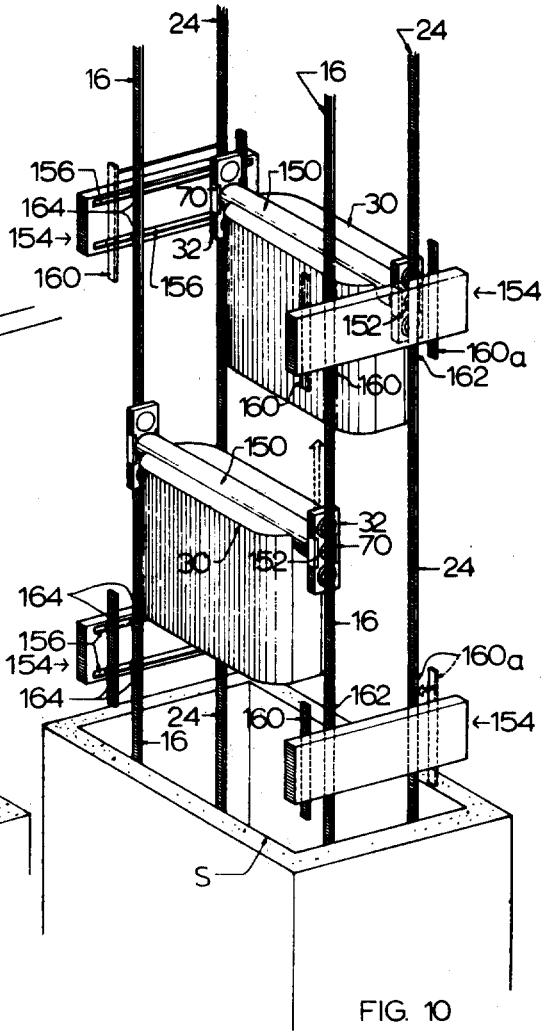
FIG. 10 is a perspective view partially in section, similar to FIG. 3 of an alternate embodiment.

Referring now to FIG. 10 illustrating an alternate embodiment, similar reference numerals have been used to designate similar components to those of the previous figures. In this embodiment, the overall system is generally similar to that of, e.g., FIGS. 1 to 4 and for the purpose of illustration, a single "up" shaft has been illustrated - it being understood that there may be provided separate up and down shafts, as well as horizontal or inclined shafts as desired. Similar reference numerals have been used to designate similar components.

In FIG. 10, the cabs or elevator capsules may per se be of any conventional construction; in this embodiment, the cabs 30 are also provided with rotational boggie frames 32 provided with linear induction motors 70 but rather than the specific embodiment of the stationary boggie frames 42 previously illustrated, a modified version is shown where the stationary bogie frames comprise an elongated frame member 150 secured to the cab 30 and projecting therebeyond at either end in a fixed shaft 152 rotatably journalled in the rotatable boggie members 32. Thus, the rotatable bogies 32 are capable of rotating about the shafts 152 similar to the arrangement disclosed hereinabove. The rotational bogies 32 will otherwise be constructed according to e.g., the arrangement illustrated in FIG. 7.

In the alternate switching mechanism illustrated in FIG. 10, the lateral switch rail assembly is indicated generally by reference numeral 154 and is adapted to be fixedly secured to the shaft S or to any other mounting for rigidly securing the same. A pair of these assemblies 154 will be located at each access station on the up and/or down shafts, which pair of assemblies will be in opposed relationship in the manner illustrated in FIG. 10. As shown therein, each assembly 154 extends between the continuous flow rails 16 and the opposed alternate rails 24 in the opposed relationship. Each assembly includes a pair of spaced-apart slots 156 in opposed upper or lower relationship, which in turn, are in opposed relationship with the respective slots of the opposed member 154. These slots 156 extend through the assembly 154 or only a portion of the depth thereof as illustrated in the embodiment of FIG. 10.

Operating in conjunction with the switch assemblies 154 are a pair of secondary switch rails indicated by reference numerals 160 and 160*a* and a primary rail indicated by reference numeral 162. The secondary rails 160 and 160*a* are adapted to be brought into and out of alignment with the continuous flow rails 16 and the alternate rails 24, while the primary rail 162 is adapted to be maintained in alignment with one or the other of the continuous rail 16 or the alternate rail 24. To this end, each of the rails 160, 160*a* and 162 are provided with a pair of laterally extending arms 164 each adapted to be slidably mounted in one of the slots 156 of the lateral switch assembly 154. Thus, each of the arms 160, 160*a* and 162 are mounted for sliding movement in the lateral switch assemblies 154.

In turn, each of the secondary arms 160, 160a may be mechanically linked together, by suitable conventional means (not shown) to operate in unison; likewise, primary rail 162 may be directly or indirectly mechanically linked (by a conventional means not shown) to either or both of the secondary rails 160 and 160*a*, whereby all three rails are mechanically linked together to operate in unison. In turn, one or more of these rails may be directly or indirectly linked by means of a suitable hydraulic ram, or like conventional means (not shown) to displace the primary rail 162 from alignment with the respective continuous rails 16 or alternate rails 24. Thus, by way of example, suitable hydraulic rams such as those described above, may be fixedly secured to the shaft S and connected to one or more of the primary or secondary rails 160, 160*a* and 162 whereby upon actuation of the ram, the rails aforementioned are brought into respective alignment with the continuous and alternate rails. It will be understood that in this embodiment, the rails 160 and 160*a* are spaced-apart a distance sufficient to be aligned respectively, with the continuous rails 16 and the alternate rails 24; while the primary rail 162 is spaced apart a distance sufficient with respect to the secondary rails 160, 160*a* that it may move between the continuous rails 16 and the alternate rails 24. In operation, when an elevator cab is to be transferred from the secondary rails 24 to the continuous rails 16, it will normally be positioned on the alternate rails 24 on a primary switch rail 162 and upon actuation of the hydraulic rams or the like, the rail 162 with the rotational bogies 32 thereon is moved whereby the primary rail 162 is transferred or pushed from the alternate rail 24 to the continuous rail 16 - in so doing, the secondary rail 160*a* is then placed into alignment with the alternate rail 24 while the other secondary rail 160 is brought out of alignment with the continuous rail 16 to permit the primary rail 162 to be placed in alignment therewith. In switching the elevator cab from the continuous rails 16 to the alternate rails 24, the reverse takes place. It will be understood that appropriate circuitry, such as that described above and hereinafter, may be utilized for actuating the switching sequence.

Referring now to FIGS. 11, 11*a* and 12, there is illustrated an alternate embodiment within the present invention. In this embodiment, separate up and down circuits are provided for the elevator cabs, as well as spaced-apart up and down stop circuits. Again, similar reference numerals have been used to describe similar components to those of the previous figures.

With reference to FIG. 11*a*, in this embodiment the shaft S may serve as embracing the up and down continuous circuits and the up and down stopping circuits, as well as providing access stations for horizontal and/or inclined loops associated with the elevator system. Within the shaft S there is included a central sub-shaft indicated by reference letter S′ spaced from the outer shaft S with the distance between the two forming a distance sufficient to accommodate elevator cabs 30 as shown in FIG. 11. The shaft S′ is fixedly spaced from the shaft S and may be secured thereto by conventional supports according to conventional construction techniques.

The cabs 30 are slightly modified from the previously described cabs. In this embodiment, the linear induction motors 170 may be provided within the cab framework per se with co-operating linear induction rail 172 being located on the sub-shaft S′. However, if desired, other suitable arrangements such as those previously described may also be employed. The cabs 30 also include multi-directional guide rollers or wheels 176 mounted in rotational boggie frames 178 which are, in turn, connected to the cab 30. Also, it has been found desirable in this embodiment to include stabilizing rollers, indicated generally by reference numeral 180, associated with the cabs 30. These stabilizing rollers are adapted to rotate against the sub-shaft S′, and of course, any horizontal or inclined shafts as described hereinafter.

As will be seen from FIGS. 11 and 11*a*, the shaft S is provided with a plurality of spaced-apart pairs of guide slots therein. The vertical guide slots are indicated generally by reference numeral 182 and are adapted to permit passage of the bogie frames 178 therethrough with a multidirectional guide roller being located interiorly of the shaft S′ whereby these rollers or wheels ride along the interior of the shaft S′. Four such pairs of guide slots 182 are included in the vertical direction of the shaft S′ when up and down continuous circuits are included and up and down alternate (stopping) circuits are also included as illustrated in FIG. 11. In a like manner, for horizontal and/or inclined circuits, horizontal guide slots 184 may be provided at appropriate spaced-apart locations in the shaft S′ for permitting the elevator cabs 30 to be diverted from the vertical shaft to the horizontal and/or inclined shaft or alternately, for switching from the continuous up-down circuits to the alternate circuits for stopping. These horizontal guide slots will intersect with the vertically aligned slots 182 in the manner illustrated in FIG. 11*a*. Normally, only one continuous guide slot 184 is provided for the horizontal direction, since as explained in the following, the movement of the cab along the horizontal and/or inclined shafts varies as opposed to movement in the shafts S and S′.

A typical horizontal shaft and inclined shaft is illustrated in FIGS. 11 and 11*a*, embodying the present invention. The horizontal shaft, indicated generally by reference numeral 186, may have one or more access stations indicated generally by reference numeral 190. In a similar manner, any inclined circuits associated with the system, such as that indicated generally by reference numeral 192 (shown in dotted lines in FIG. 11*a*), may likewise have one or more access stations 190. The horizontal circuit or loop includes a pair of spaced apart horizontal loop rails indicated generally by reference numeral 194, which operate in conjunction with the horizontal guide slots 184.

The access station construction, one of which is indicated by reference 190, may be constructed so as to provide continuous flow positions as well as stopping or extracted positions for the cabs 30. To this end, much in the manner as described with respect to FIG. 10, the access stations may include a pair of spaced-apart guide rails 200 operating in conjunction with a primary switch rail 202 and a secondary switch rail 204. The guide rails 200 are fixedly secured to the structure above the cab 30 and may, e.g. contain slots along with the primary and secondary rails 202 and 204 may slide (by virtue of the latter rails being provided with projecting arms slidably mounted in the slots, as described with respect to FIG. 10). The primary and secondary switch rails 202 and 204 may be mechanically interlocked by conventional means and suitable means for displacing the primary switch rail may be provided, such as a hydraulic ram as again described with respect to FIG. 10. In a normal operating position for a continuous flow of the elevator cabs along the horizontal loops 186, the primary switch rail is normally in closed relationship with the horizontal rails 194 whereby the cabs may continuously travel along the same. When it is desired to extract a cab from the continuous system at an access station 190, the guide rails 200 which serve as alternate rails in a manner similar to the arrangements of FIG. 1 et seq., then function to permit extraction of the cab 30 from the position shown in dotted lines in FIG. 11 to the solid line position by actuation of e.g. a hydraulic ram to slide the cab, connected in operative position to the primary switch rail 202, to the position shown in FIG. 11 whereby the secondary switch rail 204 then becomes aligned with the horizontal rails 194 to permit further continuous flow. By reversing this operation, the cab 30 is then brought back into the continuous flow position and may then assume its movement along the horizontal rails 194. Both sides of the horizontal loop may be provided with access stations in a similar manner — normally, one side being reserved for movement in one direction and the other side for movement in the other direction although this is not necessary. For movement along the horizontal system, the cabs may be provided with an alternate source of power other than linear induction motors. Thus, for example, the multi-directional guide wheels 176 may be driven — or alternately, the stabilizing rollers may likewise be driven to effect movement of the cab.

In a similar embodiment of the present invention, horizontal loops may be provided with an end structure similar to that described previously — or as illustrated in FIG. 11, may be provided with rotational transfer means to transfer the cabs for movement from one direction to movement in a return direction. As indicated therein, a horizontal shaft may be provided with a fixedly secured rotatable frame indicated generally by reference numeral 212 which comprises a pair of generally U-shaped frame members pivotally secured to the shaft or other suitable rigid means of the system. Associated with each section of the transfer frame is a switch rail indicated generally by reference numeral 214 which in turn, is also associated with the horizontal loop rails 194. When a cab, in this embodiment, is to be transferred to the return rail system, such a cab being indicated by reference 30' in dotted lines in FIG. 11, the cab is initially moved within the horizontal tube or loop as indicated by reference numeral 30'' — such movement may be effected by utilizing a system similar to that described above with respect to the horizontal access stations 190. Thereafter, the pivotably mounted transfer frame is rotated as indicated by arrows 216 whereby the cab is rotated 180 degrees to face the opposite side of the system — and upon actuation of the above described means for effecting lateral movement of the cab, the cab and switch rail assembly 214 are then placed into operative relationship with the other side of the horizontal loop rail 194.

Referring now to FIG. 12, the arrangements of FIGS. 11 and 11a are shown schematically with respect to an overall operating system. In FIG. 12, the cabs 30 shown in solid lines indicate the manner of travel for the continuous up and down circuits; while those cabs 30 shown in dotted lines indicate the alternate circuits for stopping for access stations, or for movement to horizontal or inclined loop systems. The continuous up and down circuits are connected at the top and bottom extremities thereof by intermediate lateral transfer circuits indicated generally by reference numeral 218 and 220 respectively. The horizontal loop sytems, one of which is indicated generally by reference numeral 222, may be provided with rotational transfer points (such as is described above with respect to FIG. 11), and as indicated by reference numeral 224 are with a continuous loop 226 where the horizontal rails are continuous. One or more access stations indicated generally by reference numeral 228 may also be provided on the alternate rail system for the up and/or down movement of the cabs.

Thus, there has been illustrated and described a service transport system which is capable of moving passengers or freight on a continuous flow path diverting to access station employing novel apparatus for supporting a container member for movement on a pair of rails and permitting relative shifting movement therealong and rotational movement with respect thereto. Thus, many changes and modifications in the form, arrangement, and combination of parts could be made and substituted herein shown without departing from the nature and principle of my invention. Accordingly, any and all such changes and modifications which do not depart from the nature and principle of my invention are deemed to be covered by my invention which is limited only by the following claims.

I claim:

1. A supporting apparatus for supporting a container member for movement on a pair of vertical rails and for permitting relative shifting movement therealong and rotational movement with respect thereto, said apparatus comprising a pair of first frame means, wheel means carried by each of said first frame means and rotatably disposed on said rails permitting movement of each of said first frame means therealong, a pair of second frame means pivotally mounted on said pair of first frame means and being movable therewith, link means extending between and pivotally connected to said container member and said second frame means permitting movement of said container with said first frame means and swingable movement with respect thereto, a fluid actuable means for actuating said link means to shift said container member relative to said first frame means and second frame means, and clutch means operatively associated with second frame means and mounted thereon, said clutch means permitting said container to maintain a constant angular relationship with respect to the vertical rails.

2. The apparatus of claim 1 wherein said second frame means comprises an elongated frame member having shafts extending from the axial ends thereof, said shafts being rotatably journalled in said second frame means whereby said second frame means are capable of rotating about said shafts.

3. The apparatus of claim 1, additionally comprising prime mover means operatively associated with said first frame means for powering movement of said container on said pair of rails.

4. The apparatus of claim 1 wherein said fluid actuable means comprises hydraulic ram means.

5. The apparatus of claim 1, wherein said pair of rails are of a substantially rectangular cross-section, and said wheel means are double-conical wheel means adapted to guide said container member along said rails.

6. The apparatus of claim 5, wherein said doubleconical wheel means include integral axially extending hubs and roller bearings retentively held within said first frame means, said roller bearings adapted to journal said axially extending hubs.

7. An elevator system for servicing a plurality of vertically arranged access stations, comprising a first shaft communicating with certain of said access stations, a second shaft communicating with certain other of said access stations, each of said shafts having therein continuous flow guide rail means, alternate rail means spaced from and cooperating with said guide rail means and being located proximate to said access stations, connecting rail means extending between and connecting said first and second shafts, a plurality of service capsules independently drivable on said guide rail means in a flow direction, selectively operable means for directing a capsule between said flow guide rail means and said alternate rail means, whereby capsules on said flow guide rail means may pass capsules on said alternate rail means, said capsules being movable in an upward direction on the rail means in said first shaft and downwardly on said rail means in said second shaft, and movable on said connecting rail means therebetween.

8. The system of claim 7, including means permitting selective operable shifting of said capsule from said guide rail means to said alternate rail means and back to said guide rail means.

9. The system of claim 7, wherein said guide rail means comprises a pair of spaced-apart guide rails in the form of continuous loops, and said alternate rail means comprises a pair of spaced-apart alternate rails, each of said alternate rails being located in proximity to an associated one of said pair of guide rails.

10. The system of claim 8, wherein said selectively operable means is a capsule diverting mechanism including cross-over rails from said guide rail means to said alternate rail means.

11. The system of claim 7, further comprising a supporting apparatus for said capsules on said rail means, said supporting apparatus comprising a pair of first frame means, wheel means carried by each of said first frame means and rotatably disposed on said rails permitting movement of each of said first frame means therealong, a pair of second frame means pivotally mounted on said pair of first frame means and being movable therewith, link means extending between and pivotally connected to said capsule and said second frame means permitting movement of said capsule with said first frame means and swingable movement with respect thereto, a fluid actuable means for actuating said link means to shift said capsule relative to said first frame means and second frame means, and clutch means operatively associated with second frame means and mounted thereon, said clutch means permitting said capsule to maintain a constant angular relationship with respect to the vertical rails.

* * * * *